US006053822A

United States Patent [19]

Kolodney et al.

[11] Patent Number: 6,053,822

[45] Date of Patent: Apr. 25, 2000

[54] GOLF TEE

[76] Inventors: Jeffery D. Kolodney, 7525 NW. 61st Ter., Parkland, Fla. 33067; Zvi Harpaz, 5282 Park Place Cir., Boca Raton, Fla. 33468-1461

[21] Appl. No.: 09/207,757

[22] Filed: Dec. 3, 1998

[51] Int. Cl.[7] ..... A63B 57/00

[52] U.S. Cl. ..... 473/401; 473/387

[58] Field of Search ..... 473/387–408; D21/717

[56] References Cited

U.S. PATENT DOCUMENTS

| | | | |
|---|---|---|---|
| 1,573,911 | 2/1926 | Budrow | 473/401 |
| 1,781,757 | 11/1930 | Holden | 473/387 |
| 3,414,268 | 12/1968 | Chase | 473/396 |

FOREIGN PATENT DOCUMENTS

| | | | |
|---|---|---|---|
| 236132 | 7/1925 | United Kingdom | 273/33 |
| 2258161 | 3/1993 | United Kingdom | 273/212 |

*Primary Examiner*—Steven Wong
*Attorney, Agent, or Firm*—Kenneth E. Merklen

[57] ABSTRACT

An improved golf tee includes a stem and connected head. The head includes a substantially flat upper portion with a beveled shoulder defining the periphery of the flat upper portion. A plurality of spaced holes are in the beveled shoulder. The axis of each hole generally follows the line of retains a group of bristles which extend above the upper surface of the head, forming a brush ring above the head of the tee. The brush ring extends upwardly and outwardly from the beveled shoulder defining a soft golf ball lie. The ring brush golf ball lie is adjustable, constant and portable.

6 Claims, 1 Drawing Sheet

GOLF TEE

BACKGROUND OF THE INVENTION

1. Field of the Invention

The present invention relates to golf apparatus and equipment used in playing the game of golf on a golf course and/or practicing golf on or off a golf course. In particular, the present invention relates to an improved golf tee used for teeing a golf ball during golf play and/or golf practice.

2. Prior Art

When playing the game of golf, it is usual to start the game from the teeing ground of the hole on the golf course being played. When driving a golf ball from the teeing ground, most golf players (hereinafter referred to as "players") tee the golf ball, using a golf tee. This is permitted by the rules of play for golf by the United States Golf Association. The purpose of teeing the golf ball is to raise and support the golf ball off the ground, when driving, or stroking the golf ball with a golf club. A golf tee is used in playing the game of golf and in practicing golf, especially on golf ball driving ranges and the like.

The golf tee, used for teeing a golf ball, is a device or apparatus, usually made of wood or plastic, which is about 2⅛ inches in length defined by a head and connecting stem. The stem of the tee is, for the most part, ⅛ to 3⁄16 inches in diameter and terminates in a point at one end. The point is adapted to aid in inserting the tee into the ground. At the other end of the stem the diameter increases generally to about ½ inch in diameter, to define the head of the tee. The head of the tee has an upper surface which is slightly concave, such as a dish-like surface, adapted to support a golfball, raising the golf ball above the level of the ground. When inserting the tee into the ground it is not unusual to drive the tee into the ground so that the head of the tee is substantially at ground level. This hardly lifts the golf ball above the ground. The answer to this is to increase the overall tee length but longer tees appear to be objectionable to players who carry golf tees in their pockets, for convenience. Even with longer length tees, the problem of golf ball lie exists. When the golf ball is on the ground or on a tee inserted into the ground, the golf ball is on a solid or hard lie. When the golf ball is struck with the golf club, the golf club must meet the golf ball so as to drive the golf ball forward and, at the same time, lift the golf ball off the hard lie in order to obtain a reasonably good drive. If the golf ball is not lifted at the same time as it is driven forward, the surface of the hard lie, on which the golf ball is supported, interferes with the potential flight of the golf ball. By contrast, when a golf ball is lying on grass, such as on the fairway grass, for example, the golf ball is on a soft lie, lifted off the ground by the blades of grass. Some grass lies are preferred by players over a teeing lie because grass supports a golf ball off the ground, such as is accomplished by use of a conventional golf tee, but the blades of grass under the golf ball combine to provide a soft lie for the golf ball. A grass lie provides the benefits of a conventional golf tee, that is, lifts and/or supports the golf ball off the ground, without the disadvantages of the conventional golf tee, that is, providing a soft lie rather than a hard lie for the golf ball and without potential interference with the flight of the golf ball. However, the grass lie can not be moved and the grass lie is changeable. Although the grass lie is a soft lie for a golf ball, the grass lie is not a consistent lie because of the difference in the thickness of the grass, the difference in the length of the blades of grass and the difference in the type of grass used on golf courses . These factors combine to change the characteristics of the grass lie for a golf ball from spot to spot on the same golfcourse and from golf course to golf course. Furthermore, in order to have a grass lie for a golf ball there must be grass and grass is worn off by constant use.

With the exception of hazards on the golf course, the teeing grounds, the fairways and the putting greens of a golf course are initially covered with grass. However, while good grass lies are most often available on the fairways, good grass lies are scarce on the teeing ground because the grass is usually worn off the teeing ground by constant use of the same small area by players. This is recognized by those who make the rules governing golf play and is believed to be one of the reasons a golf tee is permitted to be used on the teeing ground, to support the golf ball off the surface of the ground, where there is little or no grass.

SUMMARY OF THE INVENTION

The present invention is an improved golf tee that provides the advantages of a conventional golf tee, without the disadvantages of the conventional golf tee, relative to the golf ball lie provided by the conventional golf tee. In addition, the present invention is an improved golf tee that provides the advantages of grass, with respect to providing a golf ball lie, without the disadvantages of grass, with respect to a golf ball lie. The present invention provides an improved golf tee that is small in size, approximately the same size as a conventional golf tee, so that the improved golf tee may be conveniently carried in the pocket of a player or a golf bag, if desired, making the improved golf ball tee portable. The golf ball lie provided by the novel, improved golf tee is a soft lie which is substantially above the ground although when properly used a major portion of the improved golf tee is inserted into the ground. The golf ball lie provided by the improved golf tee is adjustable, consistent and portable. The same improved golf tee, having the same soft lie characteristics may be used over and over again, during golf play and/or in the practice of golf. The golf ball lie provided by the improved golf tee is analogous to a grass lie for a golf ball in that the golf ball lie of the improved golf tee is a soft lie, a golf ball lie that will not interfere with the potential flight of the golf ball when the golf ball is struck with a golf club and is not adequately lifted off the lie during the initial forward flight of the golf ball.

The novel improved golf tee may be used when playing the game of golf and may be used in the practice of driving or stroking a golf ball with a golf club. Use of the improved golf tee during practice, such as on a golf ball driving range, for example, has the advantage of duplicating golf ball driving conditions on a teeing ground of a golf course and simulating golf ball driving conditions on the fairway of the golf course.

The present invention provides an improved golf tee that includes a stem and a connecting head. The head includes an upper surface preferably defined by a substantially flat top and a beveled shoulder around the periphery of the flat top. The beveled shoulder terminates at the side-of-head which extends downwardly toward the stem. The beveled shoulder includes a plurality of holes spaced around the head, each for receiving a plurality of bristles which extend above the upper surface of the head. The bristles define a circular brush or brush ring extending from the head of the tee, with the circular brush defining an open area over the upper surface of the head of the tee for seating or teeing a golf ball. Preferably the axis of each hole in the shoulder of the tee is directed downward and is slightly canted toward the major axis of the stem so that the bristles received and retained in the holes extend upward from the upper surface and slightly outward, over the periphery of the beveled shoulder. In a preferred embodiment of the invention, the bristles may extend about 7/16 to 9/16 of an inch above the beveled shoulder. However, longer or shorter bristles may be used, if desired. Longer bristles will provide a higher golf ball lie. The bristles combine to define a circular brush or brush ring which defines a brush or bristle lie for a golf ball. The brush lie provides a soft lie for a golf ball, above the upper surface of the tee.

The stem of the improved golf tee corresponds favorably with the stem of a conventional golf tee in size and shape. The stem of the improved golf tee is inserted into the ground to hold the golf tee erect. The circular brush over the top of the tee defines a soft lie for a golf ball that is raised above the top of the tee. The circular brush may be considered a raised seat for a golf ball. The circular brush also defines an open area inside the ring, which gives access to the top of the tee, for applying a pressure on the top of the tee for driving the tee into the ground.

The bristles of the improved golf tee are anchored in the holes set in the shoulder of the head, which are about the periphery of the open area of the upper surface of the head, defining the circular brush lie for supporting a golf ball. The circular brush lie is defined by the plurality of flexible bristles, which, individually, are too weak to support a golf ball but the combined strengths of the plurality of bristles are sufficient to provide a soft lie for a golf ball. The circular brush or brush ring extending from the tee is a soft lie for a golf ball which compares favorably with a grass lie for a golf ball, which is also considered a soft lie. However, the circular brush lie of the present invention but is greatly superior to the grass lie in that the soft lie provided by the improved golf tee is an adjustable lie, in that the bristles may be trimmed, thus changing the height of the lie, as desired, the soft lie is a portable lie in that the improved golf ball tee is portable and the soft lie is constant, in that, once adjusted, it remains as adjusted . The portability of the improved golf tee provides a soft, circular brush lie for a golf ball that duplicates golf ball driving conditions on the teeing ground of a golfcourse and simulates golf ball driving conditions on the fairway of a golf course.

An alternative embodiment of the improved golf tee provides that the axis of each hole in the shoulder of the head of the tee extends downward toward the stem of the tee and is canted slightly away from the major axis of the stem of the tee, so that the bristles extend upward, outward and arcuately over the periphery of the head of the tee, providing an open, running ring brush over the head of the tee, for defining a soft, circular brush lie for a golf ball.

DETAILED DESCRIPTION OF THE INVENTION

Figure 1:
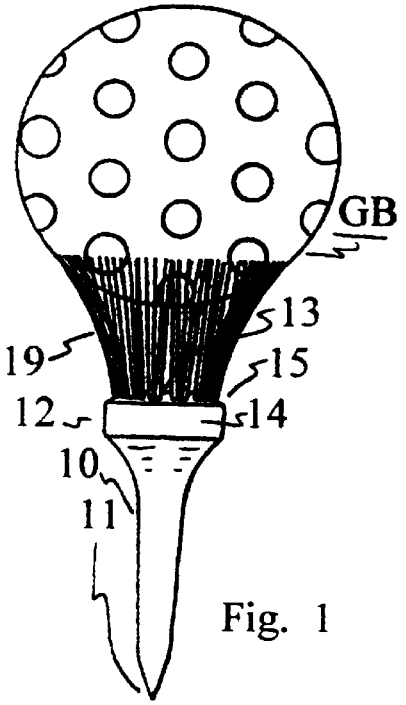
FIG. 1 is a representation of the invention supporting a golf ball in a soft, circular brush lie.
Figure 2:
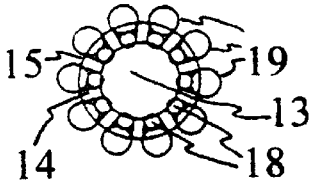
FIG. 2 is a representation of the invention in plan view.
Figure 3:
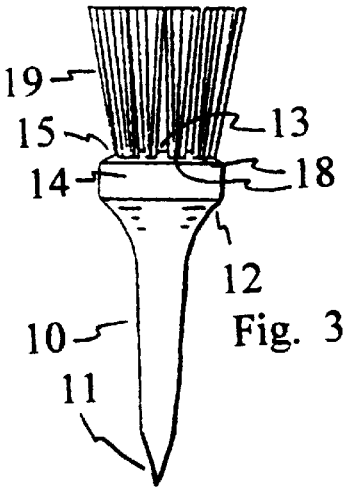
FIG. 3 is a representation of the invention in a side elevation view.
Figure 3A:
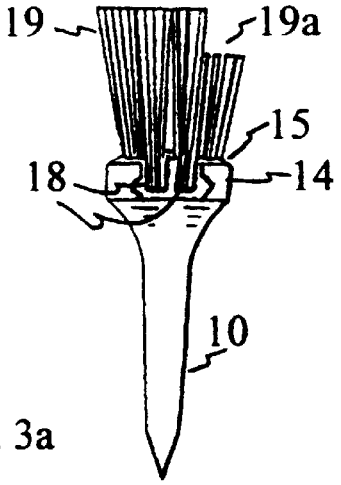
FIG. 3*a* is a representation of a preferred embodiment of the invention shown in FIG. 3, with an open section in the head of the tee.

Throughout the drawings and the detailed description of the invention, identical parts and components are identified with identical call-out numbers. FIG. 1 is a representation of a preferred embodiment of the invention supporting a golf ball GB. The improved golf tee includes a stem 10 connected to a head 12. The stem includes a pointed end 11 which aids in driving the tee into the ground. The head 12 includes an upper surface 13, a beveled shoulder 15 and a side-of-head 14. As clearly seen in FIG. 2, there are a plurality of spaced holes 18 in the head, with opening in the surface of the beveled shoulder 15. Inserted and retained in each of the holes are a plurality of bristles 19, forming a circular brush or brush ring above the periphery of the beveled shoulder. FIG. 3*a* shows side-of-head 14 cut open so that depth characteristics of the holes may be represented. It will be obvious from FIGS. 2 and 3*a* that the holes 18 extend downward, essentially following the major axis of the stem, and are canted inwardly, toward the major axis of the stem. The preferred embodiment provides a circular brush or brush ring, leaving an open center in the circular brush, above the upper surface of the head. The circular brush with open center provides a seat or lie for a golf ball, as represented in FIG. 1. FIG. 3 shows the improved golf tee, without the golf ball. The soft lie provided by the circular brush extending from the shoulder of the top of the tee, flairs out, under the weight of the golf ball. Should the player believe there is too much flair for his particular liking, the circular brush may be trimmed, as desired. Thus, the improved golf tee is adjustable, as represented in FIG. 3*a* at 19*a*.

Figure 4:
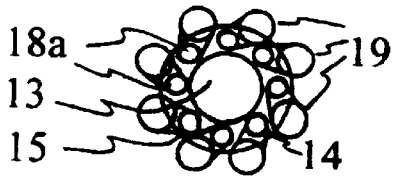
FIG. 4 is a representation of an alternate embodiment of the invention, in plan view; and, FIG. 5 is a representation of the invention represented in FIG. 4 in side elevation view with a cross cut section in the head of the tee and a portion of the bristles trimmed.
Figure 5:
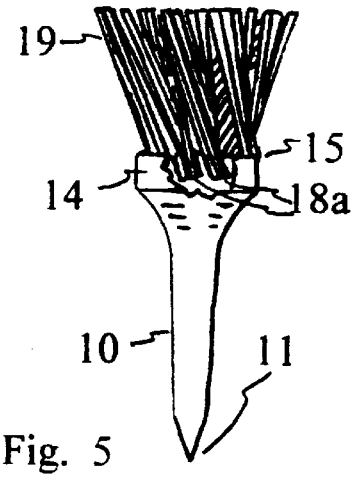

FIG. 4 is a top view of an alternate embodiment of the invention, with FIG. 5 showing the side-of-head cut open for a view of the characteristics of the holes 18*a*, which extend downward, following the major axis of the stem, canted inwardly toward the major axis and inclined off parallel, relative the major axis so that the bristles held in the holes 18*a* extend upwardly, outwardly and incline peripherally defining a running ring brush above the periphery of the beveled shoulder. In each construction of the invention a circular, open centered, soft, brush or bristle lie for a golf ball is provided. Some players may prefer a brush ring lie, such as provided by the embodiment of the invention represented in FIGS. 1,2 3 and 3*a*. Other players may prefer running ring brush lie, such as provided by the embodiment of the invention represented in FIGS. 4 and 5. Whether one prefers an improved golf tee with a brush ring lie or a running ring brush lie, both are portable and both may be trimmed to a desired length, making both adjustable, as desired.

Preferably, the body of the improved tee, i.e., the stem and connecting head, is 2 to 2¼ inches in length. The head of the improved tee is approximately 7/16 to 9/16 inches in diameter. The bristles in the circular brush defining the golf ball lie extend above the top of the head approximately 7/16 to 9/16 inches. However, if the circular brush defining the golf ball lie has excessive flair when seating a golf ball, or the golf ball is held too high off the ground for personal preference, the bristles defining the circular brush lie may be adjusted to a shorter length, by trimming, for example, if desired.

Preferably, the head of the improved golf tee is substantially flat, with a beveled shoulder on the periphery of the head. An alternate embodiment of the invention may include a head with an upper surface which is substantially flat or an upper surface which is convex, if desired. An head of tee with a convex upper surface may obviate a beveled shoulder. If desired, the head of the improved golf tee may include a concave area on the upper surface to provide a non-slip push-area for inserting the tee into the ground.

The bristles, anchored in and extending from the holes in the head of the improved golf tee define a soft, circular or ring brush lie for a golf ball. The ring brush lie provided is superior to a grass lie for a golf ball in that the ring brush lie is adjustable, is consistent and is portable. The golf ball lie provided is adjustable in that the bristles which define the ring brush lie may be trimmed, as desired, to provide a golf ball lie that meets personal requirements. The ring brush lie is consistent in that after adjustment the ring brush lie remains unchanged. The adjusted, consistent ring brush lie provided by the improved golf tee is usable over and over again, without change and the improved golf tee is portable.

A preferred embodiment of the present invention has been described along with several alternative embodiments. In the forgoing description of the invention, referenced to the drawings, certain terms have been used for conciseness, clarity and comprehension. However, no unnecessary limitations are to be implied from or because of the terms used, beyond the requirements of the prior art, because such terms are used for descriptive purposes and are intended to be broadly construed. Furthermore, the description and illustration of the invention are by way of example, and the scope of the invention is not limited to the exact details shown, represented or described.

Having described a preferred embodiment of the invention, along with certain alternative construction and suggested changes, other changes that may become apparent to those skilled in the art may be made, without departing from the scope of the invention defined in the appended claims.

What is claimed is:

1. A golf tee for providing a soft lie for a golf ball comprising:

a) a stem member connected to a head member, said stem member having a free end adapted to be inserted into a means for retaining said golf tee in an upright position;

b) said head member having an upper portion defined by a top portion and a shoulder, said shoulder defining a periphery of said top portion and terminating at a side-of-head of said head member;

c) a plurality of holes in said shoulder, spaced along said shoulder and about said periphery of said top portion, each hole of said plurality of holes extending into said head member in a direction substantially following a major axis of said stem member and said each hole canted toward said major axis, said each hole for receiving and retaining a group of bristles respectively; and d) a plurality of groups of bristles, each group of bristles of said plurality of groups of bristles received and retained in said each hole, respectively, in said shoulder for providing a circular brush member above said shoulder for defining said soft lie for a golf ball.

2. A golf tee as in claim 1 wherein said shoulder is a beveled shoulder defining said periphery of said top portion.

3. A golf tee as in claim 1 wherein said top portion is convex and said shoulder follows the contour of said top portion.

4. A golf tee as in claim 1 wherein said top portion is a substantially flat portion and said shoulder is a beveled shoulder defining a periphery of said substantially flat portion.

5. A golf tee as in claim 1 wherein said each hole in said shoulder extends into said head member in a direction substantially following a major axis of said stem member and said each hole is canted toward said major axis and off set from said major axis, and said circular brush member defined by said plurality of groups of bristles is an open running ring brush that extends upward from said shoulder, outward over a periphery of said shoulder and arcuately about said periphery of said shoulder for defining said soft lie for a golf ball.

6. A golf tee as in claim 1 wherein said shoulder is a beveled shoulder and each hole of said plurality of holes extends downwardly from said beveled shoulder into said head member substantially following a direction of a major axis of said stem member and said each hole is canted toward said major axis and offset from said major axis for directing a major axis of each hole upwardly and outwardly and arcuately above said beveled shoulder, and wherein each said group of bristles of said plurality of groups of bristles include bristles that extends upwards, outwards and arcuately over said beveled shoulder, and said circular brush member is an open, running ring brush, defining said soft lie for a golf ball.

* * * * *